United States Patent [19]

Diehl et al.

[11] 4,202,671

[45] May 13, 1980

[54] FUEL CONDITIONER

[75] Inventors: Richard C. Diehl, Shingle Springs, Calif.; Jerry L. Walker, Coraopolis, Pa.

[73] Assignee: Calgon Corporation, Pittsburgh, Pa.

[21] Appl. No.: 926,692

[22] Filed: Jul. 21, 1978

[51] Int. Cl.[2] ..... C10L 1/30

[52] U.S. Cl. ..... 44/68; 44/DIG. 3; 252/396

[58] Field of Search ..... 44/68, DIG. 3; 252/396

[56] References Cited

U.S. PATENT DOCUMENTS

| | | | |
|---|---|---|---|
| 2,697,033 | 12/1954 | Ambrose et al. | 44/68 |
| 2,943,925 | 7/1960 | Ambrose | 44/66 |
| 3,692,503 | 9/1972 | Kukin | 44/68 |
| 3,837,820 | 9/1974 | Kukin | 44/DIG. 3 |

*Primary Examiner*—Winston A. Douglas
*Assistant Examiner*—Y. Harris-Smith
*Attorney, Agent, or Firm*—Mario A. Monaco; Martin L. Katz

[57] ABSTRACT

Composition containing organic magnesium and organic manganese compounds as a fuel conditioner to reduce fuel requirements and sulfur trioxide emissions and method of using same.

3 Claims, No Drawings

FUEL CONDITIONER

This invention relates to a composition and method for conditioning fuel oils to reduce fuel oil requirements and sulfur trioxide emissions produced during combustion.

More particularly, this invention relates to a composition and method for conditioning fuel wherein the composition contains organic magnesium and organic manganese compounds.

The use of the fuel conditioning compositions of the present invention provide many advantages. The compositions of the present invention assure more complete burning of fuel oil; permit a reduction of the excess air required for complete combustion; reduce the amount of smoke, soot, unburned carbon and particulate matter in stack plumes; reduce sulfur trioxide emissions; and reduce fuel consumption.

The fuel conditioning compositions of the present invention contain organic magnesium and organic manganese compounds. Suitable organic magnesium compounds include oil-soluble magnesium sulfonates and magnesium carbonates. A particularly preferred organic magnesium compound is distributed by Witco Chemical Corporation under the name of HYBASE® n-400, a magnesium sulfonate and magnesium carbonate in oil of the formula:

$$(C_{22}H_{45}C_6H_4SO_3)_2\,Mg + MgCO_3$$

Suitable organic manganese compounds include manganese salts of mixed aliphatic acids, as for example, compounds of the formula:

$$(C_nH_{2n+1}COO)_xM_n$$

wherein n=4 to 20 and x=2 or 4. The organic magnesium and organic manganese compounds may be present in a weight ratio of from 0.1 to 10 parts organic magnesium compound per part organic manganese compound. In use, the organic magnesium and organic manganese compounds are blended together in fuel oil to provide an oil-soluble composition having a concentration of from 1 to 10 weight percent magnesium and 1 to 15 weight percent manganese. This composition may be fed to the combustion chamber in a concentration of 10 to 10,000 mg/1, preferably 75 to 1,500 mg/1 of fuel oil.

The following example will illustrate the advantages of the fuel conditioning compositions of the present invention:

EXAMPLE

A composition containing 40 percent by weight No. 2 Fuel Oil; 10 percent by weight of a 12 percent solution of manganese salts of mixed aliphatic acids distributed by Tenneco Chemicals, Inc., as Nuxtra® Manganese 12; and 50 weight percent of an organic magnesium compound distributed by Witco Chemical Corporation as HYBASE® n-400 was fed to a boiler for six weeks at a concentration of one gallon per 1500 gallons of a high sulfur oil. Combustion efficiency was increased and fuel consumption decreased by 2.3%; sulfur trioxide emissions were reduced by 75% and the rate of corrosion was reduced.

We claim:

1. A fuel oil conditioning composition consisting essentially of from 0.1 to 10 parts by weight of at least one organic magnesium compound selected from the group consiting of magnesium sulfonates and magnesium carbonates per part by weight of at least one organic manganese salt of mixed aliphatic acids.

2. A method of conditioning combustible fuel oils to improve combustion efficiency and reduce sulfur trioxide emissions during combustion which comprises adding prior to combustion from 0.1 to 10 parts by weight of at least one organic magnesium compound selected from the group consisting of magnesium sulfonates and magnesium carbonates per part by weight of at least one organic manganese salt of mixed aliphatic acids.

3. A composition comprising from 75 to 1,500 mg/1 of fuel oil of a fuel oil conditioning composition consisting essentially of from 0.1 to 10 parts by weight of at least one organic magnesium compound selected from the group consisting of magnesium sulfonates and magnesium carbonates per part by weight of at least one organic manganese salt of mixed aliphatic acids.

* * * * *